United States Patent [19]

Strobel

[11] Patent Number: 4,644,114

[45] Date of Patent: Feb. 17, 1987

[54] ASSEMBLY FOR COUPLING SWITCH HANDLES

[75] Inventor: Albert Strobel, Cherry Hill, N.J.

[73] Assignee: Heinemann Electric Company, Lawrenceville, N.J.

[21] Appl. No.: 811,534

[22] Filed: Dec. 20, 1985

[51] Int. Cl.[4] ..... H01H 9/20

[52] U.S. Cl. ..... 200/50 C; 200/DIG. 006

[58] Field of Search ..... 200/11 G, 11 J, 11 K, 200/14, 50 C, DIG. 006

[56] References Cited

U.S. PATENT DOCUMENTS

| | | | |
|---|---|---|---|
| 3,200,208 | 8/1965 | Mastney | 200/14 X |
| 3,272,934 | 9/1966 | Schwartz et al. | 200/50 C |
| 3,299,231 | 1/1967 | Camp et al. | 200/50 C |
| 3,649,784 | 3/1972 | Middendorf et al. | 200/DIG. 006 X |
| 3,801,758 | 4/1974 | Shand et al. | 200/DIG. 006 X |
| 4,225,758 | 9/1980 | Kondo et al. | 200/11 G X |

*Primary Examiner*—J. R. Scott

*Attorney, Agent, or Firm*—Dann, Dorfman, Herrell & Skillman

[57] ABSTRACT

A switch coupling assembly for coupling at least a pair of switches having respective spaced apart actuator handles is provided in order to permit simultaneous switching of the separate switches. Generally tubular spacers fit between each pair of switch handles. At least one tubular spacer is dimensioned with sufficient clearance so that one end of the spacer abuts one of the switch handles while the other end of the spacer is spaced apart from the other switch handle. The switch handles are each provided with alignable openings and a tie rod is dimensioned to extend through the aligned openings in the switch handles and the spacers to couple the switch handles together. The tie rod has a groove alignable in the clearance between the spacer and the adjacent switch handle. A snap ring snugly fits in the clearance to hold the spacer in position and engages the groove on the tie rod to prevent relative movement of the tie rod. The switch handles are thereby coupled together to enable simultaneous movement of the handles.

17 Claims, 5 Drawing Figures

ASSEMBLY FOR COUPLING SWITCH HANDLES

FIELD OF THE INVENTION

The present invention relates to an assembly for coupling switch handles and, more particularly, to a assembly which couples a plurality of aligned switch handles for separate switching units to permit simultaneous switching.

BACKGROUND OF THE INVENTION

In various applications, it is often desirable to effect simultaneous switching of different switching units, such as circuit breakers, supported relative to one another on a common panel or frame. Interconnecting the switch handles of the respective switching units enables movement of one switch handle to cause the similar movement of all the switch handles thereby causing the respective switching units to be simultaneously actuated. In a common application, the switch handles of separate circuit breakers may be coupled together to enable simultaneous switching. The coupling of circuit breakers is useful in applications where circuits must be protected by separate circuit breakers but where it is still desirable, or even necessary, for the conducting states of the individual circuits coupled to all the circuit breakers to be uniformly switched from one state to another.

Various arrangements have been utilized to interconnect handles of adjacent circuit breakers to permit simultaneous switching. However, none of the conventional arrangements have been particularly satisfactory.

Conventionally, the switch handles of adjacent circuit breakers have been connected by a tie pin inserted through aligned holes in adjoining switch handles to couple the handles together. In the conventional systems, however, the tie pin is axially dimensioned to extend through the aligned holes in the adjacent handles so that the end portions of the tie pin protrude beyond the respective handles at both outer ends. To retain the tie pin in position, separate retainers are required at both ends of the tie pin to prevent axial movement of the pin through the holes in handles. For this purpose, a separate retaining ring has been removably secured to each of the protruding ends of the tie pin. In an alternative arrangement, a tie pin having an integral head fixed at one end of the pin is employed so that the head is provided on one of the protruding ends of the pin while a removable retaining ring is secured to the other protruding end to prevent the pin from falling out. In still another arrangement, a rivet having an integral head fixed at one end is passed through the aligned holes in the handles for riveting a sheet metal brace or handle tie in position on the handles with both the head and crimped end of the rivet projecting outwardly from the ends of the handles. In yet another embodiment, a metal clamp is secured to the outer surface of the switch handles by staking the ends of the clamp into the holes of the switch handles along the outer end surfaces of the switch handles. In each of the conventional arrangements, however, the handle tie or brace used to interrconnect the switch handle protrudes beyond the outer ends of the handles. In many applications, the protruding ends of the handle tie result in an undesirable arrangement. For example, not only are the protruding ends of the handle ties aesthetically unpleasing, but in certain applications, the protruding ends may interfer with the operation of the circuit breaker by impeding switch movement through inadvertent contact with external objects. Another draw back with the conventional arrangements is that a retainer whether it is an integral head or a removably retaining ring, must be used at both ends of the tie pin.

Other conventional arrangements have utilized tie pins having tangs for anchoring into the switch handle. One of the problems with using anchoring tangs for securing a tie pin to a switch handle is that the handle material must be relatively soft. Otherwise, the anchoring tang will have a tendency to crack the switch handle as the tang digs into the handle during the insertion of the tie pin into the handle opening. In applications where relatively hard materials must be used for the switch handles in order to reduce flamability, for example, the problem of handle cracking caused by the use of anchoring tangs is greatly increased.

In accordance with the present invention, an assembly for coupling switch handles is provided which overcomes the problems inherent with the conventional arrangements. More specifically, the unique assembly for coupling adjacent spaced apart switch handles in accordance with the present invention eliminates the protrusion of the tie pin beyond the ends of the switch handles. As a result, any possibility that the ends of the coupling assembly may inadvertantly catch on adjacent objects or otherwise interfere with the operation of the circuit breakers is eliminated. In addition, by eliminating the protruding ends, the aesthetics of the coupling assembly in accordance with the present invention is greatly enhanced. Further, the need for using separate retainers at both ends of the tie pin in order prevent the pin from moving or falling out of the handle openings is also eliminated resulting in increased efficiency and cost effectiveness. Another problem which is overcome is that the assembly in accordance with the present invention may be used with handles constructed of materials having varying degrees of hardness without any danger of causing cracks or creating large maounts of stress on the switch handles.

SUMMARY OF THE INVENTION

In accordance with the present invention, a switch coupling assembly is provided. At least a pair of switch means are held together in side by side arrangement with each switch means having a switch handle movable relative to the switch means for actuating the respective switch means. The switch means are oriented so that the switch handles may move in spaced apart essentially similar parallel paths of movement. The switch handles have respective openings therethrough alignable along an axis generally perpendicular to the parallel paths of movement when the handles are moved to essentially similar positions along the respective parallel paths of movement.

Generally tubular spacers are dimensioned to fit between each pair of spaced apart switch handles. One of the spacers is dimensioned to a first size to fit between a pair of the switch handles with predetermined clearance between the spacer of the first size and an adjacent one of said switch handles. Spacers of a second size are dimensioned to snugly fit between the remaining pairs of adjacent switch handles. The tie rod is dimensioned to extend through the spacers and the openings in the switch handles. The tie rod includes a circumferential groove located for alignment in the clearance between the spacer of the first size and the adjacent switch handle. the retainer is dimensioned to snugly fit in the predetermined clearance to snugly hold the retainer and the spacer of the first size in position between the pair of switch handles and to engage the groove on the tie rod to hold the tie rod in position so that the switch handles are coupled together for simultaneous movement.

BRIEF DESCRIPTION OF THE DRAWINGS.

The foregoing summary, as well as the following detailed description of the preferred embodiments of the present invention, will be better understood when read in conjunction with the accompanying drawings, in which.

DETAILED DESCRIPTION OF THE PREFERRED EMBODIMENT

Figure 1:
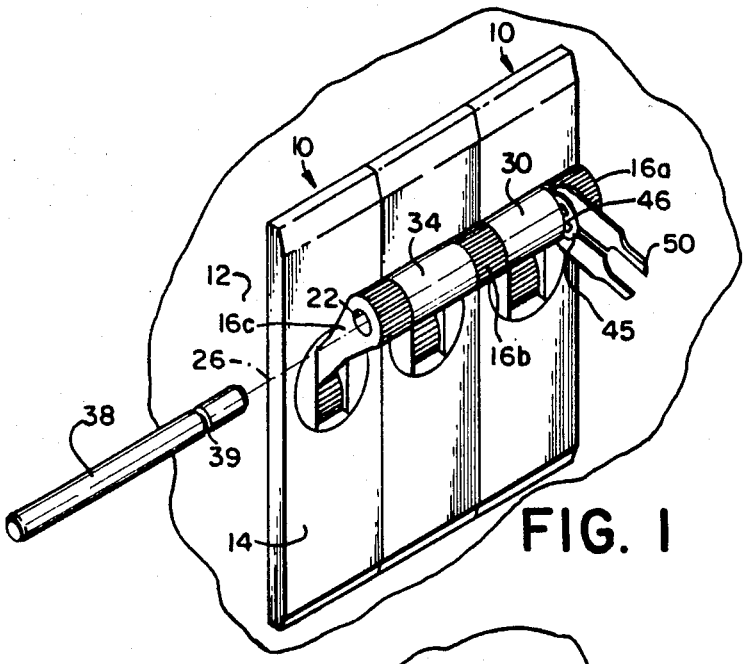
FIG. 1 is a partially exploded perspective view of an assembly for coupling adjacent spaced apart switch handles in accordance with the present invention.

Referring to the figures, a series of individual switching units, such as circuit breakers, generally designated 10, are mounted on a panel 12 in side-by-side arrangement. Face plates 14 for the circuit breakers 10 cover and overlap an opening in the panel 12 through which the circuit breakers are inserted in order to stop the circuit breakers at the panel 12. Various mounting brackets may be used to support and retain the circuit breakers 10 in position on the panel 12.

Switch handles 16*a*, 16*b* and 16*c* protrude from the face plate 14 of the respective circuit breakers to enable manual actuation of the respective circuit breakers. The circuit breakers 10 are supported relative to one another so that the switch handles 16 are rotatably movable along generally parallel arcuate paths of movement between stopped positions for actuating the respective switch mechanisms. For example, the switch handles may be rotatable between a first stopped position for opening the contacts of the circuit breaker 10 and a second stopped position for closing the contacts of the circuit breaker 10. To permit effective coupling, the movement of the switch handles must be along essentially similar paths. The circuit breakers are positioned so that the handles, or corresponding points in each handle, can be made to lie in essentially similar positions aligned along an axis generally perpendicular to the parallel paths of movement. The switch handles are alignable at all similar positions of the switch handles along the respective paths of movement.

Figure 2:
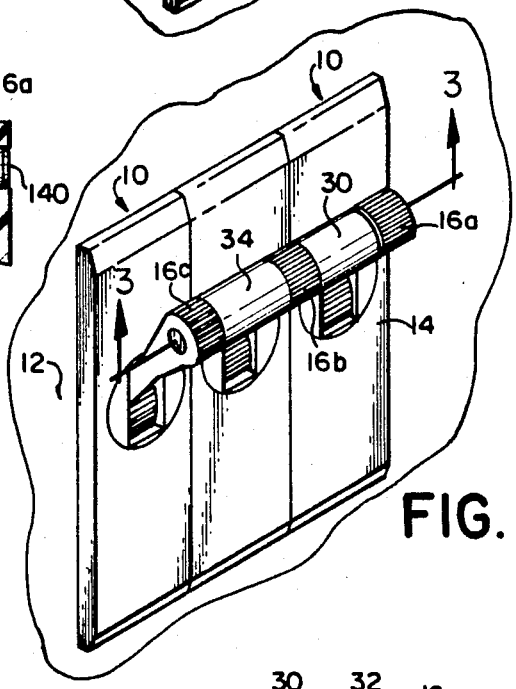
FIG. 2 is a perspective view of the assembly for coupling switch handles in accordance with the present invention.
Figure 5:
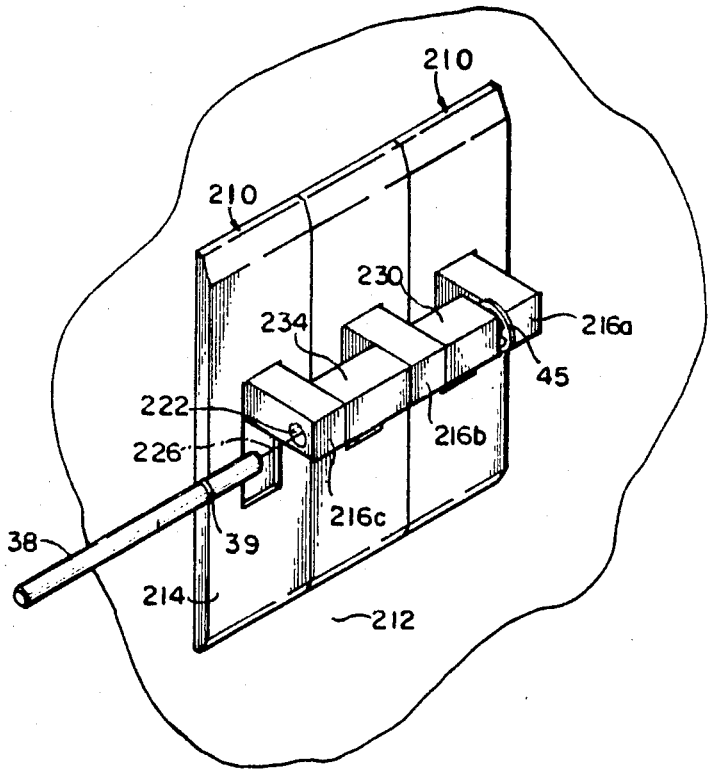
FIG. 5 is a partially exploded perspective view of the coupling assembly in accordance with the present invention as employed with switching mechanisms having slide-type actuator handles movable along generally parallel linear paths of movement.

The circuit breakers 10 are mounted on a panel 12 in side-by-side arrangement so that the switch handles 16*a*, 16*b* and 16*c* of the respective units, or similar points on the respective handles, are oriented in adjacent spaced apart positions in generally parallel planes containing the respective paths of movement so that the switch handles are movable in the same general predetermined directions. The handles, or similar points on the handles, are able to be placed along the similar paths of movement in a common plane oriented generally perpendicular to the paths of movement. As illustrated in FIGS. 1 and 2, the switch handles 16 are positioned for rotatable movement about a generally common axis of rotation oriented at a generally right angle to the paths of movement so that the switch handles move about the rotational axis in generally parallel arcuate paths between stopped positions. Other types of switching arrangements may also be used, for example, a slide-type switch arrangement as illustrated in FIG. 5 in which the switch handles are manually movable along generally parallel linear paths between stopped positions. For effective coupling, it is desirable for the circuit breakers which are to be coupled together to include switch handles which are movable in the same general predetermined directions along essentially similar paths.

Referring to FIGS. 1 and 2, an opening 22 extends through each of the switch handles 16*a*, 16*b* and 16*c*. Each opening 22 is generally cylindrical in shape and is oriented with its cylindrical axis extending generally parallel to the axis of rotation of the switch handles 16*a*, 16*b* and 16*c* and generally perpendicular to the paths of movement. The circuit breakers 10 are oriented in the side-by-side arrangement so that the openings 22 through the switch handles 16*a*, 16*b* and 16*c* may be aligned along a common axis, such as axis 26, shown in FIG. 1. For example, the openings 22 are conveniently aligned along an axis when the switch handles 16*a*, 16*b* and 16*c* are disposed in the same stopped switching position.

Figure 3:
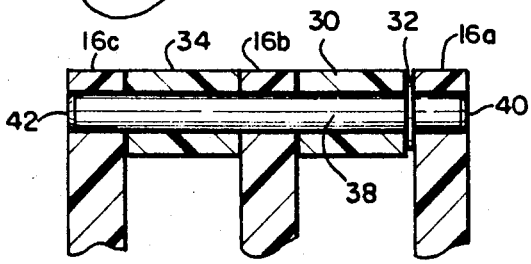
FIG. 3 is a cross-sectional view of the assembly taken along line 3—3 of FIG. 2.

A generally tubular spacer 30 preferably having a generally outer cylindrical shape matching the shapes of the ends of the handles 16*a*, 16*b* and 16*c* is dimensioned to fit longitudinally between a pair of the adjacent spaced-apart switch handles with predetermined clearance. As best illustrated in FIG. 3, spacer 30 fits between handles 16*a* and 16*b* so that one end of the spacer 30 abuts the side of switch handle 16*b* and the other end of the spacer is spaced from the side of switch handle 16*a*. A space 32 is provided between the end of the spacer 30 and the side of switch handle 16*a*. The tubular spacer 30 is provided with a generally cylindrical axial bore of the same general cross-sectional diameter as the openings 22 through the switch handles 16*a*, 16*b* and 16*c*. The axial bore provides a passageway through the spacer. The tubular spacer is positionable between switch handles 16*a* and 16*b* so that the axial cylindrical bore through the spacer 30 is axially aligned in registry with the openings through the switch handles 16*a* and 16*b* which are preferably of the same cross-sectional diameter.

A generally tubular spacer 34 of a second size is dimensioned to fit between remaining pairs of spaced-apart switch handles, such as 16*b* and 16*c*, desirably in snug fit. Spacer 34 may have a somewhat longer axial length than spacer 30 so that one end of the spacer 34 abuts the side of switch handle 16*b* and the other end of the spacer 34 abuts the side of switch handle 16*c*. A central generally cylindrical bore of the same diameter as the openings 22 through the switch handles 16*a*, 16*b* and 16*c* extends through the tubular spacer 34 to provide a passageway therethrough.

In various arrangements, the clearance between spacer 30 and switch handle 16*a* may be sufficiently small so that spacer 34 may have the same axial length as spacer 30. For example, if there is some lateral play in the switch handles in a direction generally perpendicular to the usual path of movement, switch handle 16*a*, for example, can be moved away from spacer 30 to provide the necessary clearance 32 therebetween. When the clearance 32 is created by the lateral movement of the switch handles away from the spacer, the spaces between the adjacent switch handles may be effectively filled by spacers 30 and 34 having the same axial length.

Although the embodiment illustrated in FIGS. 1–3 shows a series of three circuit breakers, additional circuit breakers may be added to the series For each circuit breaker which is added to the series shown in FIGS. 1–3, an additional spacer 34 should desirably be utilized to fill the space between the additional spaced apart switch handles.

In order to couple the circuit breaker handles together to permit simultaneous movement, a rigid elongated tie rod 38 is utilized. The tie rod is dimensioned to extend through the aligned bores of the spacers 30 and 34 and openings of the switch handles 16*a*, 16*b* and 16*c*. The tie rod desirably has a cross-sectional diameter which generally conforms to the diameter of the bores in the spacers 30 and the openings in the handles 16*a*, 16*b*, and 16*c* so that the tie rod is snugly accommodated within the bores of the spacers and the openings through the switch handles 16*a*, 16*b*, and 16*c*. To retain the tie rod in position captured within the openings of the switch handles 16*a*, 16*b* and 16*c* and the bores of the spacers 30 and 34, the tie rod 38 includes an annular outer peripheral groove 39. The annular groove 39 on tie rod 38 is located at a predetermined position along the longitudinal axis of the tie rod 38 so that when the tie rod is inserted within the aligned openings of the switch handles 16*a*, 16*b* and 16*c* and the bores of the spacers 30 and 34, the annular groove 39 is positioned in alignment with the space 32 provided between spacer 30 and switch handle 16*a*. The axial length of the tie rod is such that when the tie rod 38 is passed through the aligned passageways of the switch handles 16*a*, 16*b* and 16*c* and the bores of the spacers 30 and 34, one end 40 of the tie rod is completely contained within the openings of switch handle 16*a* and the other end 42 of the tie rod is completely contained within the openings of switch handle 16*c* so that neither end of the tie rod 38 protrudes beyond the switch handles.

In order to hold the tie rod in position captured within the spacers 30 and 34 and the switch handles 16*a*, 16*b* and 16*c*, a retainer 45, such as a snap ring in the form of an E-ring, is utilized. The E-ring retainer 45 is generally disc shaped and is dimensioned to snugly fit in the space 32 between the spacer 30 and the switch handle 16*a* to snugly hold the retainer 45 and the spacer 30 in position between the switch handles 16*a* and 16*b*. The E-ring retainer 45 includes a catch portion 46, such as the arms of the E-ring, which is dimensioned for insertion within the peripheral slot 39 on the tie rod in snug fit to prevent axial movement of the tie rod through the switch handle openings. The spacer 30 and switch handle 16*a* cooperate to prevent axial movement of the retainer 45 by holding the retainer snugly in place therebetween. The catch portion 46 of the retainer 45 is mechanically engaged with the tie rod 38 and stops axial movement of the tie rod because of the snug engagement of generally parallel faces of the catch portion 46 with generally parallel side walls of groove 39. The E-ring retainer 45 when engaged with groove 39 holds the tie rod in position coupling the switch handles together to enable simultaneous movement of the handles.

During assembly, the tie rod 38 is passed through the openings 22 in the switch handles 16*a*, 16*b* and 16*c* and the respective bores of the spacers 30 and 34, starting the insertion from either end of the series of switch handles. When the ends of the rod 38 terminate within the openings of switch handles 16*a* and 16*c*, peripheral groove 39 is aligned next to handle 16*a* in the space 32 between handle 16*a* and spacer 30 so as to permit engagement with the E-ring retainer.

Since it is desirable for the E-ring retainer 45 to fit within the space 32 between spacer 30 and switch handle 16*a* in snug fit, a combination insertion-removal tool 50 may be utilized to push the E-ring retainer 45 into proper position between spacer 30 and handle 16*a* until arms 46 of the retainer 45 are inserted into the annular groove 39 of the tie rod 38 where its inherent spring action causes it to latch onto the tie rod in the groove. After assembly, the tie rod cannot move and couples the switch handles together to enable simultaneous movement of the handles. Movement of one of the switch handles from one stopped position to another stopped position causes all the coupled handles to move in unison. The rigidity of the assembly causes the other switch handles to move in the same predetermined direction as the switch handle which is manually moved. With the coupling assembly, individual circuit breakers 10 can be coupled together so that the switching state of each circuit breaker changes substantially simultaneously with the state of the other circuit breakers.

Figure 4:
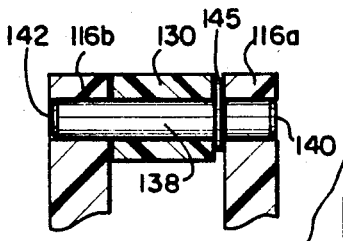
FIG. 4 is a cross-sectional view similar to FIG. 3 of a slightly modified version of the coupling assembly in which only one pair of adjacent spaced apart switch handles are coupled together.

Reffering to FIG. 4, a coupling assembly is illustrated which is substantially similar to the assembly illustrated in FIGS. 1–3. The major difference is that only two adjacently spaced apart switch handles 116*a* and 116*b* are coupled together. The tie rod used in the embodiment of FIG. 4, therefore, has a shorter axial length. The tie rod 138 is dimensioned to extend through aligned openings through switch handles 116*a* and 116*b* and spacer 130. Spacer 130 is dimensioned to fit between handles 116*a* and 116*b* with one end of the spacer 130 abutting switch handle 116*b* and the end of the spacer being spaced apart from handle 116*a* to form a space therebetween.

The tie rod 138 is of a selected axial length so that one end 140 of tie rod 130 is contained completely within the opening through switch handle 116*a* and the other end 142 is contained completely within the opening through switch handle 116*b* so that neither end protrudes from the handle openings. An E-ring retainer 145 is utilized to hold the tie rod in position to prevent axial movement of the tie rod through the openings in the same manner as described for the previous embodiment. The E-ring retainer 145 is dimensioned to fit within the space between spacer 130 and switch handle 116*a* in snug fit so that the spacer 130 and the E-ring retainer 145 are snugly held in position between the switch handles 116*a* and 116*b*. As described with respect to the previous embodiment, the coupling assembly enables simultaneous movement of switch handles 116*a* and 116*b* in the same general predetermined directions along general similar parallel paths of movement to effect simultaneous actuation of the respective circuit breakers.

Referring to FIG. 5, a coupling assembly is illustrated which is substantially similar to the assembly illustrated in FIGS. 1–3. The major difference is that the switching units generally designated 210 in FIG. 5 include slide-type switch handles 216*a*, 216*b*, and 216*c*, which are configured to move along essentially similar generally parallel linear paths of movement rather than rotatable paths of movement as the embodiment of FIGS. 1–3. The circuit breakers 210 include face plates 214 for covering the opening through the panel 212 on which the circuit breakers are mounted in side by side arrangement. Spacers 230 and 234 are dimensioned to have outer generally rectangular shapes conforming to the outer rectangular shapes of the switch handles 216*a*, 216*b*, and 216*c*. Spacer 234 is dimensioned to fit snugly between switch handles 216*b* and 216*c* and spacer 230 is dimensioned to fit between switch handles 216*a* and 215*b* to provide predetermined clearance therebetween. Like the embodiment previously described in connection with FIGS. 1–3, the switch handles include openings 222 and the spacers 230 and 234 include axial bores which may be axially aligned, for example, along axis 226, to accept tie rod 38. The openings 222 through the handles and the bores through the spacers 230 and 234 may be of a generally cylindrical shape having a cross-sectional diameter which conforms to the outer cylindrical shape of tie rod 38 so that the tie rod may by snugly held within the switch handles and the spacers in snug fit. The tie rod 38 is dimensioned so that the ends of the tie rod terminate within switch handles 216*a* and 216*c* respectively. The tie rod 38 includes an annular peripheral groove 39 at a predetermined longitudinal position along the tie rod so as to be aligned within the clearance between spacer 230 and switch handle 216*a*. Like the previously described embodiments, an E-ring retainer 45 may be inserted within the predermined clearance between switch handle 216*a* and spacer 230 so that the retainer 45 engages the tie rod 38 within the annular groove 39. The E-ring retainer is dimensioned to fit within the predetermined clearance between spacer 230 and switch handle 216*a* in snug fit so that the spacer 230 and the E-ring retainer 45 are snugley held in position between switch handles 216*a* and 216*b*. As described with respect to the previous embodiments, the coupling assembly enables simultaneous movement of the switch handles 216*a*, 216*b*, and 216*c*, in the same general predetermined directions along generally similar parallel linear paths of movement to effect simultaneous actuation of the respective circuit breakers.

It will be recognized by those skilled in the art that changes and modifications may be made without departing from the broad inventive concepts of the present invention. It is understood, therefore, that the present invention is not limited to the particular embodiments illustrated and described herein, but is intended to cover all changes and midifications within the scope and spirit of the invention as set forth in the appended claims.

What is claimed is:

1. A switch coupling assembly comprising:

(A) at least a pair of switch means held together in side by side arrangement, each switch means having a switch handle movable relative to the switch means for actuating the respective switch means, the switch means being oriented so that the switch handles may move in spaced apart essentially similar parallel paths of movement, the switch handles having respective openings therethrough alignable along an axis generally perpendicular to the parallel paths of movement when the handles are moved to essentially similar positions along the respective parallel paths of movement;

(B) generally tubular spacers dimensioned to fit between each pair of spaced apart switch handles, one of the spacers dimensioned to fit between a pair of said handles with predetermined clearance between said spacer and an adjacent one of said switch handles;

(C) a tie rod dimensioned to extend through the spacers and the openings in said switch handles, said tie rod having a groove located for alignment in the clearance between said spacer and said adjacent switch handle; and (D) a retainer dimensioned to snugly fit in the predetermined clearance to snugly hold the retainer and spacer in position between said pair of switch handles and to engage said groove on the tie rod to hold the tie rod in position so that the switch handles are coupled together for simultaneous movement.

2. The swtich coupling assembly in accordance with claim 1 wherein the openings through each of the switch handles are generally cylindrical having central axes oriented generally perpendicular with respect to the paths of movement of the respective switch handles.

3. The assembly in accordance with claim 1 wherein said switch handles are rotatably movable about a generally common axis of rotation oriented generally parallel with respect to aligned openings through the switch handles and at a generally right angle relative to the paths of movement of the respective switch handles.

4. The assembly in accordance with claim 1 wherein said switch handles are movable relative to the switch means along generally linear paths of movement.

5. The assembly in accordance with claim 1 wherein the tie rod is dimensioned so that each end of the tie rod terminates within a handle opening.

6. The assembly in accordance with claim 1 wherein the openings within the switch handles are dimensioned to conform in cross sectional shape to the cross section of the tie rod and the tie rod is snugly engaged within each opening.

7. The assembly in accordance with claim 1 wherein said groove is generally circumferential and the retainer is a snap ring having a portion snugly retained within said groove.

8. The assembly in accordance with claim 1 wherein the groove on the tie rod includes generally parallel side walls and the retainer includes a portion having generally parallel faces snugly retained within the groove in engagement with the respective parallel side walls of the groove.

9. The assembly in accordance with claim 1 wherein only one of said spacers is dimensioned to a first size to provide said clearance between said spacer and said adjacent switch handle and all of the remaining spacers are dimensioned to a second size to fit between respective pairs of switch handles in generally snug fit.

10. A switch coupling assembly comprising:

(A) a pair of switch means held together in side by side arrangement, each switch means having a switch handle movable relative to the switch means for actuating the respective switch means, the switch means being oriented so that the switch handles may move in spaced apart essentially similar parallel paths of movement, each switch handle having an opening therethrough alignable with the opening of the other switch handle along an axis generally perpendicular to the parallel paths of movement when the handles are moved to essentially similar positions along the respective parallel paths of movement;

(B) a generally tubular spacer dimensioned to fit between the spaced apart switch handles with predetermined clearance between the spacer and one of the switch handles;

(C) a tie rod dimensioned to extend through the spacer and the openings in said switch handles, the tie rod having a groove located for alignment in the clearance between the spacer and the switch handle; and (D) a retainer dimensioned to snugly fit in the predetermined clearance to snugly hold the retainer and the spacer in position between the switch handles and dimensioned to engage said groove on the tie rod to hold the tie rod in position so that the switch handles are coupled together for simultaneous movement.

11. The switch coupling assembly in accordance with claim 10 wherein the openings through each of the switch handles are generally cylindrical having central axes oriented generally perpendicular with respect to the paths of movement of the respective switch handles.

12. The assembly in accordance with claim 10 wherein said switch handles are rotatably movable about a generally common axis of rotation oriented generally parallel with respect to the aligned openings through the switch handles and at a generally right angle relative to the paths of movement of the respective switch handles.

13. The assembly in accordance with claim 10 wherein said switch handles are movable relative to the switch means along generally linear paths of movement.

14. The assembly in accordance with claim 10 wherein the tie rod is dimensioned so that each end of the tie rod terminates within a handle opening.

15. The assembly in accordance with claim 10 wherein the openings within the switch handles are dimensioned to conform in cross sectional shape to the cross section of the tie rod and the tie rod is snugly engaged within each opening.

16. The assembly in accordance with claim 10 wherein said groove is generally circumferential and the retainer is a snap ring having a portion snugly retained within the groove.

17. The assembly in accordance with claim 10 wherein the groove on the tie rod includes generally parallel side walls and the retainer includes a portion having generally parallel faces snugly retained within the groove in engagement with the respective parallel side walls of the groove.

* * * * *